US005201890A

United States Patent [19]

Sauer et al.

[11] Patent Number: 5,201,890

[45] Date of Patent: Apr. 13, 1993

[54] RAILROAD CAR HANDBRAKE RELEASE SYSTEM

[75] Inventors: Robert J. Sauer, Blackwood, N.J.; Michael J. Pavlick, Blue Bell, Pa.

[73] Assignee: Transit America, Inc., Philadelphia, Pa.

[21] Appl. No.: 799,335

[22] Filed: Nov. 27, 1991

[51] Int. Cl.[5] ..... F16D 65/14

[52] U.S. Cl. ..... 188/107; 74/155; 74/505

[58] Field of Search ..... 188/107; 74/505, 506, 74/155; 60/536

[56] References Cited

U.S. PATENT DOCUMENTS

| | | | |
|---|---|---|---|
| 1,061,900 | 5/1913 | Clelland | 74/506 X |
| 1,368,796 | 2/1921 | Haas | 74/506 X |
| 1,872,063 | 8/1932 | Camp | 74/505 X |
| 3,390,590 | 7/1962 | Natschke et al. | 74/505 |
| 3,444,756 | 5/1969 | Andonian | 74/505 |

FOREIGN PATENT DOCUMENTS

| | | | |
|---|---|---|---|
| 4183 | of 1911 | United Kingdom | 188/107 |

*Primary Examiner*—George E. A. Halvosa

*Attorney, Agent, or Firm*—Walter B. Udell

[57] ABSTRACT

A manually operated railroad car handbrake release system in which the release of the handbrake at one end of a car automatically causes release of the brakes at the opposite end of the same car. The system utilizes the standard type handbrake, but has affixed to each of the handbrake units a hydraulic cylinder, with interconnecting hydraulic lines between hydraulic cylinders located at opposite ends of the railcar. Brake releasing actuation at one handbrake unit pressurizes the hydraulic system so that the cylinder affixed to the brake unit at the opposite end of the car is also actuated to operate the release handle and release the brake at that end. When the release handles are actuated and released, return springs disposed about the cylinders piston rods automatically return the release handles and pistons at both ends to their non-actuated positions. The brake release system is operative from either end of the railroad car, and does not include any provision for resetting the brakes. Setting of the manually operated brakes is carried out as though the brake release system did not exist, namely, each brake mechanism must be individually operated to set its associated brake.

11 Claims, 2 Drawing Sheets

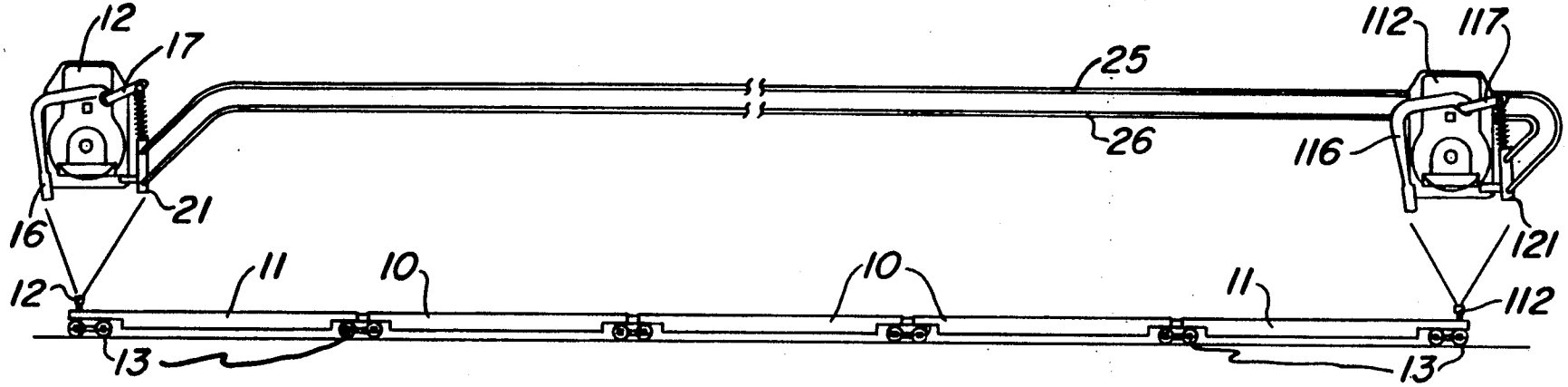
FIG. 1
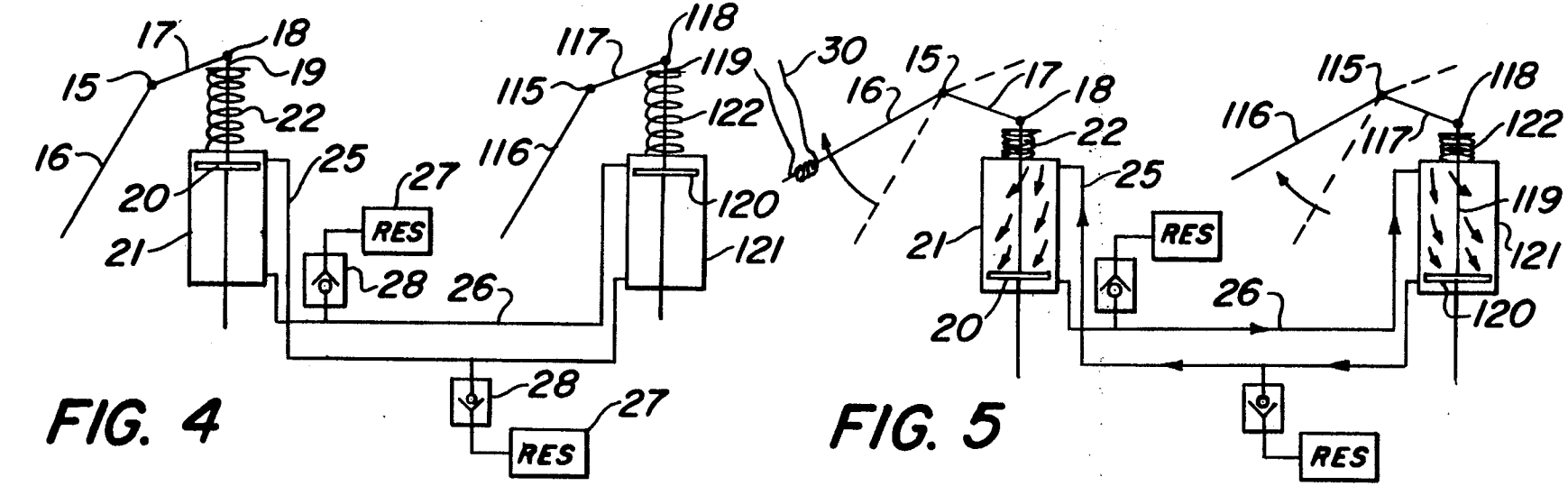
FIG. 5
FIG. 4

RAILROAD CAR HANDBRAKE RELEASE SYSTEM

This invention relates to handbrakes for railroad cars, and more particularly relates to a hydraulic system for the release of a handbrake located remotely from the point where brake release actuation is effected. Railroad cars use manually mechanically set brakes to lock the wheels of railroad car trucks when the cars are standing still, as for example in a marshalling yard or on a siding.

Mechanical railroad car handbrakes are used when railroad cars are standing still to prevent the cars from rolling from the desired location. These manually applied brakes include brake shoes positioned to engage the railroad car wheels which seat on the rail heads. When the car is stopped, the brake is set by manually rotating a handbrake wheel which pulls on an endless chain arrangement rotating a ratchet controlled drum to move the brake shoes inward toward and against the car wheels.

This type of brake system is fitted with a release handle which disengages the ratchet device so that the release of chain tension causes the brake shoes out of engagement with the car wheels.

Experience has shown that it is not unusual that one or more of the mechanically set handbrakes in a string of railroad cars on occasion have failed to have been released, with the unfortunate consequence that when the railroad cars are moved from their stopped position the still engaged brakes have caused the wheels with which they are engaged to remain locked and to be dragged along the railhead rather than to rotate. This causes extreme wear on the railhead and very rapid development of flats on the wheels. The wheel damage is not repairable, and the cars so affected must be taken into the shop for wheel replacement, a not inexpensive procedure. The cumulative annual cost of this type of repair is considerable and has been a worrisome problem in the railroad industry.

The problem has apparently been exacerbated by the increasingly widespread use of multi-platform articulated railcars which have the manually set braking systems placed at opposite ends of the full car length, which may be five or six platforms in length and extend for a linear distance of three hundred feet or more. The railroad personnel may release the brakes at the ends of adjacent cars, and for some unaccountable reason fail to walk to the opposite ends of these lengthy cars and release the brakes at those opposite ends. It is believed that in most cases these incidents are inadvertent, but whatever the reason the resulting damage is costly, not only requiring wheel re placement but also sometimes causing substantial delays in shipment of goods being carried by the disabled cars.

This problem is resolved by the handbrake release system according to the invention by providing a manually operated mechanism whereby the release of the handbrake at one end of a car automatically causes release of the brakes at the opposite end of the same car. The system according to the invention utilizes the standard type handbrake, but has affixed to each of the handbrake units a hydraulic cylinder, with interconnecting hydraulic lines between the cylinders located at opposite ends of the railcar. Brake releasing actuation at one handbrake unit pressurizes the hydraulic system so that the cylinder affixed to the brake unit at the opposite end of the car is also actuated to operate the release handle and release the brake at that end. When the release handles are actuated and released, return springs disposed about the cylinders piston rods automatically return the release handles and pistons at both ends to their non-actuated positions. The brake release system is operative from either end of the railroad car, and does not include any provision for resetting the brakes. Setting of the manually operated brakes is carried out as though the brake release system did not exist, namely, each brake mechanism must be individually operated to set its associated brake.

Accordingly, it is a primary object of the invention to provide a novel handbrake release system for simultaneously releasing the set handbrakes at opposite ends of a railroad car when the handbrake release actuator at either end of the car is actuated to release its associated brake.

Another object of the invention is to provide a novel handbrake release system as aforesaid which utilizes hydraulic actuators connected to the standard handbrake mechanisms and which are interconnected by hydraulic fluid lines.

A further object of the invention is to provide a novel handbrake system as aforesaid in which the hydraulic cylinders incorporate spring return devices for returning the pistons of the cylinders to their initial positions after the brakes release actuating handle has been released.

Yet another object of the invention is to provide a novel handbrake release system utilizable with multi-platform railroad cars of considerable linear length in which the interconnecting hydraulic lines are provided with detachable flexible sections between adjacent platforms of the composite car.

The foregoing and other objects of the invention will become clear from a reading of the following specification in conjunction with an examination of the appended drawings, wherein:

FIG. 1 is a schematic showing of the novel handbrake release system according to the invention used in conjunction with a five platform articulated railroad car;

Figure 2:
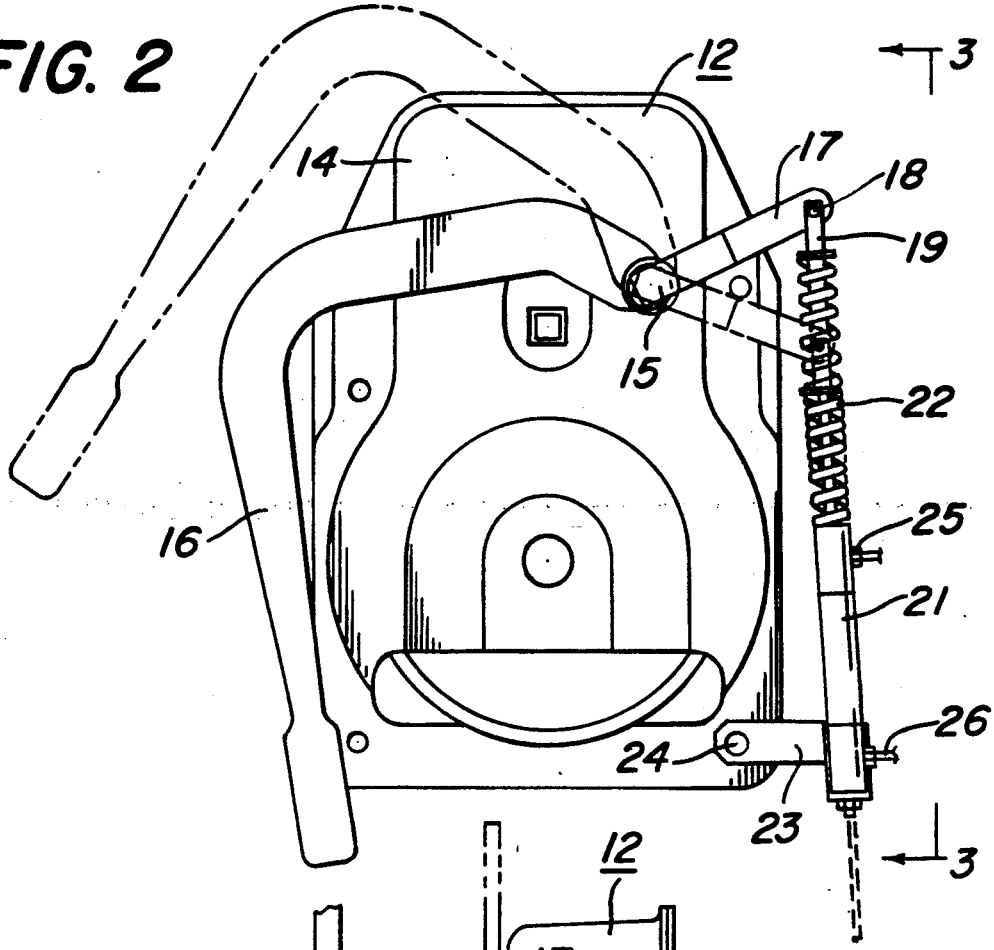
FIG. 2 is a front elevational view of a typical handbrake mechanism with the brake setting handwheel removed which has mounted to it a hydraulic cylinder utilized as part of the remote brake releasing mechanism.

FIG. 4 is a schematic representational showing of the hydraulic system according to the invention which effects the handbrake release, the components being shown with the actuating handles in their normal deactuated position; and FIG. 5 is similar to the showing of FIG. 4 but illustrating the changed hydraulic cylinder conditions when the brake release actuator at one cylinder is manually actuated.

In the several figures, like elements are denoted by like reference characters.

Figure 3:
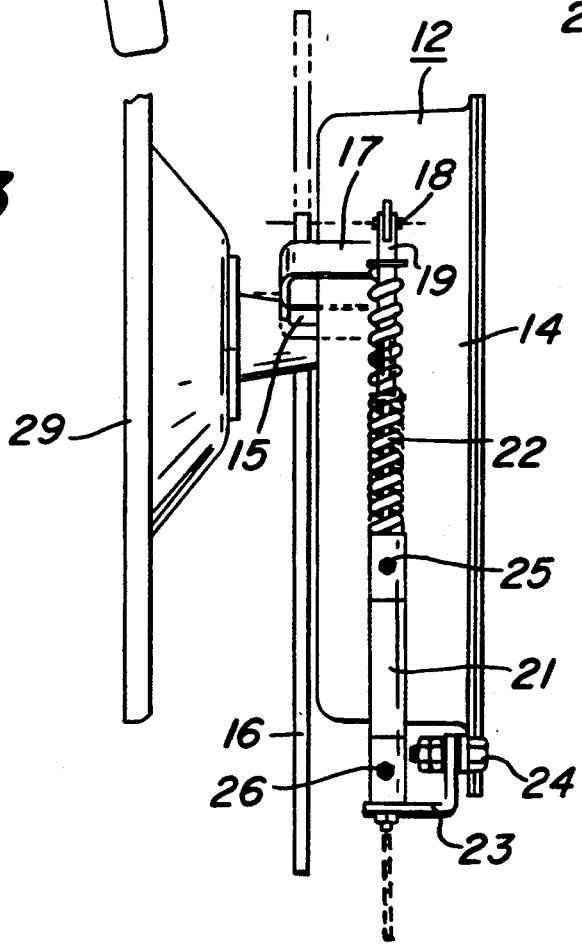
FIG. 3 is a side view of the mechanism shown in FIG. 2 as would be seen when viewed along the lines 3—3 on FIG. 2 but with the handwheel shown.

Considering first FIGS. 1, 2 and 3 there is seen an articulated railroad car made up of five platforms, the three interior platforms being designated by the reference number 10 while the two end platforms are designated as 11. Installed at the outer ends of each of the end platforms 11 are a pair of identical handbrakes 12 and 112 respectively which set and release the handbrakes associated with each of the trucks 13 of the end units of the car. Displayed above the handbrake actuators shown fixed on the end platforms are enlarged views showing the general configuration with the brake setting handwheels not shown for clarity, these devices being seen in larger scale in FIGS. 2 and 3 as well.

As best seen in FIGS. 2 and 3, the handbrake 12 is seen to be the conventional standard device having a body housing 14, an operating ratchet release shaft 15 and brake release actuating handle 16 for rotating the release shaft 15. Rigidly secured to the ratchet release shaft 15, as for example by welding, is a piston driver arm 17 pivotally connected as at 18 to the upper end of the piston rod 19 of which the piston 20 connected at its lower end is disposed within the hydraulic cylinder 21. The piston 20 is not visible in the showings of FIGS. 2 and 3 but is seen in representational form in FIGS. 4 and 5. The piston rod 19 is surrounded by a compression spring 22 which biases the piston rod out of the hydraulic cylinder 21. The lower end of the hydraulic cylinder 21 is fixedly connected to a bracket 23 which is pivotally connected as at 24 to the handbrake housing 14.

Interconnecting the upper and lower ports of the hydraulic cylinders 21 and 121 at opposite ends of the railroad car are hydraulic lines 25 and 26, connected so that the upper port of one cylinder is connected to the lower port of the other cylinder, the lines being maintained pressurized by reservoirs 27 and checkvalves 28. The showings of FIGS. 2 and 3 represent the handbrake 12 shown at the left end of FIG. 1, so that the hydraulic line 25 is shown connected to the upper cylinder port and the hydraulic line 26 is shown connected to the lower cylinder port. Also shown in FIG. 3 is the brake handwheel 29 which by rotation operates the chain drum inside the brake housing 14 to set the brake, this handwheel being omitted from FIG. 2.

The operation of the handbrake, independently of the associated hydraulic system is as follows. Assuming that the brake is in its released condition and that the car has just been brought to a stop at a desired location, the brake handwheel 29 is rotated to operate the chain drum inside of the brake housing 14 and tighten the chain which sets the brake against the railroad car wheels. Rotation of the brake handwheel 29 to set the brake does not affect the brake release actuating handle 16 which remains in its position shown in solid line in FIGS. 1 and 2. When it is desired to release the brake, the actuating handle 16 is manually pulled upward to its dashed lined position as shown in FIG. 2, rotating the ratchet release shaft 15 to release the retaining ratchet and chain tension to release the brakes from engagement with the railroad car wheels. When it is again desired to set the handbrake, the brake handwheel 29 is again operated as before, with the release sequence being as already described.

The hydraulic release system which includes the hydraulic cylinder structure, hydraulic lines and piston driver arm 17 and bracket 23 operates as follows, reference now being had to FIGS. 4 and 5 to which attention should be directed. FIG. 4 shows the system in its normal passive state, which may be either in a brake set or a brake released condition depending upon whether or not the brake handwheel 29 had been operated to set the brake. FIG. 5 illustrates the operation of the brake release actuating handle 16 from its quiescent state shown in dashed line corresponding to the showing of FIG. 4, to its actuated state shown in solid line in FIG. 5. Under this latter condition as shown in FIG. 5, the actuating handle 16 has been pulled upward by the representational arm 30 to rotate the ratchet release shaft 15, as previously described, to release the brakes controlled by brake controller 12. This simultaneously causes the piston driver arm 17 to pivot with the shaft 15 to which it is rigidly fixed and drive piston rod 19 and piston 20 downward inside cylinder 21 against the bias of compression spring 22 to thereby pressurize hydraulic line 26 and depressurize hydraulic line 25. Hydraulic fluid is thus forced through lines 26 and 25 to pressurize the upper surface and depressurize the lower surface of piston 120 in hydraulic cylinder 121 and drive the piston downward inside cylinder 121. Piston rod 119 is thereby drawn downward into the cylinder, compressing spring 122, pivoting piston driver arm 117 and rotating brake ratchet release shaft 115 to release the brake normally released by upward pull on brake release actuating handle 116, which latter is of course also pivoted upward as shown. Accordingly, manual actuation of release handle 16 at brake unit 12 has also released brake unit 112. Identically the same operation takes place if release handle 116 is actuated instead of release handle 16. When the actuated release handle 16 or 116 is manually released, the compression springs 22 and 122 drive the piston rods 19 and 119 upward out of hydraulic cylinders 21 and 121, reversing the flow of hydraulic fluid through lines 25 and 26 and restoring the conditions shown in FIG. 4. The compression springs also return the release handles to their normal position.

Having now described the invention in connection with a particularly illustrated embodiment thereof, variations and modifications of the invention may now naturally occur to those persons normally skilled in the art without departing from the essential scope or spirit of the invention, and accordingly, it is intended to claim the invention broadly as well as specifically as indicated by the appended claims.

What is claimed is:

1. A manually operated railroad car handbrake release system for simultaneously releasing the manually set car brakes at opposite ends of the car whenever the brakes at either end of the car are released, comprising in combination, a) first and second manually operated handbrakes each including a brake setting mechanism and a brake releasing means, said first handbrake being fixedly located at one end of the railroad car and said second handbrake being fixedly locatable at the other end of the railroad car, b) a first actuatable hydraulic cylinder mechanically coupled to an actuatable by said brake releasing means of said first manually operated handbrake, said first hydraulic cylinder having upper and lower ports and a piston connected to a piston rod having a free end, and means biasing said piston to one end of said cylinder with the piston rod and its free end positioned out of said cylinder, c) a second actuatable hydraulic cylinder mechanically coupled to and actuatable by said brake releasing means of said second manually operated handbrake, said second hydraulic cylinder having upper and lower ports and a piston connected to a piston rod having a free end, and means biasing said piston to one end of said cylinder with the piston rod and its free end positioned out of said cylinder, d) hydraulic fluid carrying means intercoupling said first and second hydraulic cylinders, each of said first and second hydraulic cylinders being effective responsive to actuation by its associated brake releasing means to actuate the other of said first and second hydraulic cylinders via said hydraulic fluid carrying means and to thereby actuate the other brake releasing means to release the brakes of both of said first and second manually operated handbrakes. compression spring disposed about its associated piston rod outside of said cylinders.

2. A railroad car handbrake release system as set forth in claim 1 wherein said pistons biasing means each comprises a cylindrical compression spring disposed about it's associated piston rod outside of said cylinders.

3. A railroad car handbrake release system as set forth in claim 1 wherein said hydraulic fluid carrying means comprises a series of rigid sections intercoupled by flexible sections.

4. A railroad car handbrake release system as set forth in claim 1 wherein each brake releasing means comprises a manually operated actuating handle mechanically coupled to the said free end of each piston rod.

5. A railroad car handbrake release system as set forth in claim 1 wherein siad pistons biasing means each comprises a cylindrical compression spring disposed about it's associated piston rod outside of said cylinders.

6. A manually operated railroad car handbrake release system for simultaneously releasing the manually set car brakes at opposite ends of the car whenever the brakes at either end of the car are released, comprising in combination, a) first and second manually operated handbrakes each including a brake setting mechanism and a brake releasing means, said first handbrake being fixedly located at one end of the railroad car and said second handbrake being fixedly locatable at the other end of the railroad car, b) a first actuatable hydraulic cylinder mechanically coupled to and actuatable by said brake releasing means of said first manually operated handbrake, said first hydraulic cylinder having upper and lower ports and a piston connected to a piston rod having a free end, and means biasing said piston to one end of said cylinder with the piston rod and its free end positioned out of said cylinder, c) a second actuatable hydraulic cylinder mechanically coupled to and actuatable by said brake releasing means of said second manually operated handbrake, said second hydraulic cylinder having upper and lower ports and a piston connected to a piston rod having a free end, and means biasing said piston to one end of said cylinder with the piston rod and its free end positioned out of said cylinder, d) a pair of hydraulic lines intercoupling said first and second hydraulic cylinders, one of said pair of lines connecting the upper port of said first cylinder to the lower port of said second cylinder, and the other of said pair of lines connecting the upper port of said second cylinder to the lower port of said first cylinder, each of said first and second hydraulic cylinders being effective responsive to actuation by its associated brake releasing means to actuate the other of said first and second hydraulic cylinders via said pair of hydraulic lines and to thereby actuate the other brake releasing means to release the brakes of both of said first and second manually operated handbrakes.

7. A railroad car handbrake release system as set forth in claim 6 wherein said hydraulic lines comprises a series of rigid sections intercoupled by flexible sections.

8. A railroad car handbrake release system as set forth in claim 7 wherein each brake releasing means comprises a manually operated actuating handle mechanically coupled to the said free end of each piston rod.

9. A railroad car handbrake release system as set forth in claim 8 wherein said pistons biasing means each comprises a cylindrical compression spring disposed about its associated piston rod outside of said cylinders.

10. A railroad car handbrake release system as set forth in claim 6 wherein each brake releasing means comprises a manually operated actuating handle mechanically coupled to the said free end of each piston rod.

11. A railroad car handbrake release system as set forth in claim 6 wherein said pistons biasing means each comprises a cylindrical compression spring disposed about its associated piston rod outside of said cylinders.

* * * * *